United States Patent [19]

Allmendinger

[11] 4,019,584

[45] Apr. 26, 1977

[54] FIRE EXTINGUISHER

[75] Inventor: Norbert Allmendinger, Willoughby Hills, Ohio

[73] Assignee: Richmond Industries, Inc., Willoughby, Ohio

[22] Filed: Dec. 1, 1975

[21] Appl. No.: 636,522

[52] U.S. Cl. ..... 169/74; 169/89

[51] Int. Cl.[2] ..... A62C 13/00

[58] Field of Search ..... 169/71, 74, 77, 88, 169/89

[56] References Cited

UNITED STATES PATENTS

| | | | |
|---|---|---|---|
| 2,704,582 | 3/1955 | Bowman | 169/89 X |
| 3,662,836 | 5/1972 | Siimes | 169/89 |

FOREIGN PATENTS OR APPLICATIONS

| | | | |
|---|---|---|---|
| 549,966 | 10/1956 | Italy | 169/88 |
| 1,121,587 | 7/1968 | United Kingdom | 169/88 |

*Primary Examiner*—Johnny D. Cherry
*Assistant Examiner*—Michael Mar

[57] ABSTRACT

A fire extinguisher is disclosed which is activated by operation of a unique valve and handle assembly. The handle of the fire extinguisher, which is to be utilized to operate the valve, is designed to simplify construction and assembly of the component parts in addition to simplifying recharging and servicing of the extinguisher. The handle is attached to the valve body through the use of only one rivet while being nonetheless permanently positioned with respect to the nozzle. The handle is further useful to simplify securing the nozzle to the valve body.

11 Claims, 7 Drawing Figures

FIRE EXTINGUISHER

BACKGROUND OF THE INVENTION

1. Field of the Invention

The present invention relates generally to portable fire extinguishers and, more particularly, to an improvement in a handle for a portable fire extinguisher which activates a valve controllably releasing the pressurized contents.

Portable fire extinguishers are well known in the art. Controlled release of a pressurized fluid, in fire extinguishers or any other use, is likewise well known in the art. However, improvements in controlled release of fire extinguisher fluids have continuously been tried and proposed. The search is never ending, as in any art, for a more efficient, more dependable and less expensive control means.

The instant invention represents a novel approach to solving the problems of controlled release while seeking to solve all three of the above goals. In this respect, the number of parts involved is reduced thus cutting the expense and simplifying assembly and servicing. At the same time, the simplification of servicing in particular benefits the efficiency and dependability of the device.

2. Prior Art

Although portable fire extinguishers have been around for a long time, the present invention deals more specifically with a controllable release mechanism for a fluid under pressure in a fire extinguisher. As such, the prior art of concern is that dealing with mechanisms for controlled release.

One of the earliest such mechanisms for controlled release is taught by U.S. Pat. No. 2,067,829 wherein a plunger F serves as both a punch for opening a diaphragm and a sealing valve. In this case, the activation of the extinguisher is controlled by lifting the trigger H once the sealing diaphragm has been broken. When the trigger is lifted the seal $F^2$ of the plunger F is spaced from the valve seat E' to allow the fluid to escape. Since the plunger is spring biased, releasing the trigger reseats the valve and stops the escaping fluid.

A considerable improvement with respect to controlled release in fire extinguishers is shown by U.S. Pat. No. 2,506,074. This patent utilizes, by now, practically conventional portable fire extinguisher components, e.g., tank 7, valve body 10, plunger 29 and pick-up tube 17. To the top of the valve body a cap 37 and pair of handles 45 and 52 are attached. The handle 45 pivots about pin 48 on the cap and the handle 52 pivots about pin 53 on the handle 45. The addition of the sliding plunger 54, controllably releases the pressurized fluid when the handles 45 and 52 are properly orientated.

The claimed advantage in U.S. Pat. No. 2,506,074 is that the fluid is released when the handle 52 is pressed into the handle 45 while the handle 45 is being lifted towards point 43 of the cap. However, if the handle 45 is not lifted, fluid will not be released regardless of the pressing of handle 52.

Admittedly, the mechanism of U.S. Pat. No. 2,506,074 is unique in providing operative and inoperative handle or trigger positions. Unfortunately, most persons under conditions requiring the use of a fire extinguisher may not be able to appreciate the intricate design of the mechanism. In fact, the inoperative feature may cause serious problems when a potential user neglects to lift handle 45 prior to attempting to utilize the extinguisher. While this criticism is not meant to downgrade the uniqueness of the mechanism of the patent, the drawback with regard to the efficiency of the unit must be considered.

Another mechanism for controllably releasing a fluid under pressure from a fire extinguisher is shown by U.S. Pat. No. 2,530,092. In this case, there is only one handle connected to the tank by a pivot and a valve plunger by a pivoted link. Operation is affected by lifting the handle which in turn lifts the valve plunger off a seat and releases the fluid. The pivoted link provides two stable positions, blocking release and allowing release of the fluid, respectively.

Finally, U.S. Pat. No. 3,359,149, while claiming a locking feature for the valve handle mechanism, shows a valve handle mechanism very similar to that which is most often utilized on pressurized, portable fire extinguishers.

Two handles, operated by gripping and pulling the two together, relatively, is the means used to operate the valve plunger in U.S. Pat. No. 3,356,149 and most recent portable fire extinguishers. Each of the two handles are pivotally attached at separate pivot points to the valve body or some extension thereof. Clearly, the valve body, or an extension thereof, is required to be specially machined, cast or otherwise formed, in order to accommodate the pivoting of both handles. The pivoting of both handles separately increases the cost of manufacturing and assembly of the unit. But further, maintenance or servicing of the unit is rendered more complex and expensive as a result of the double pivot and extra parts.

U.S. Pat. No. 3,356,149, as noted above, claims an advantage in rendering the handles 14 and 21 self locking to prevent accidental discharge of the extinguisher. As mentioned above, the state of the user under the specific conditions applicable to the use of fire extinguishers may in fact result in the self-locking feature being a handicap rather than an advantage. This view of the claimed advantage is not meant to deny any uniqueness attributable to the patent by the inventor.

SUMMARY OF THE INVENTION

This invention has as a general object the provision of a new and improved portable fire extinguisher.

Other objects of this invention are to provide a new and improved portable fire extinguisher which is more economical to construct and assemble, which is more efficient to operate, and which is more readily serviced.

Still other objects of this invention are to provide a new and improved portable fire extinguisher which utilizes a double handle grip to activate a release valve, which utilizes a unique valve body attaching both handles with a single pivot pin, and which renders one of the two handles immobile relative to the fire extinguisher.

Further still other objects of this invention are to provide a new and improved portable fire extinguisher which allows a discharge nozzle to be utilized without the necessity of threads in the valve body, which allows a discharge nozzle to be utilized without the necessity of threads at all, and which allows for servicing of the fire extinguisher without the necessity of disassembling a majority of component parts of the fire extinguisher.

These and other objects and advantages of this invention will appear from the following description of preferred forms thereof, reference being made to the accompanying drawings.

DESCRIPTION OF THE PREFERRED EMBODIMENT

Hand held, manually operated fire extinguishers have long been in use. Of these hand held, and thus portable, fire extinguishers many have been of the variety of a precharged fluid under pressure. Clearly, when such an extinguisher is utilized, it is desirable to be able to release the pressurized fluid at a controlled rate. The present invention, while utilizing a number of conventional elements of portable, pressurized fluid fire extinguisher, presents a novel means for controllably releasing the pressurized fluid at the will of an operator.

Figure 1:
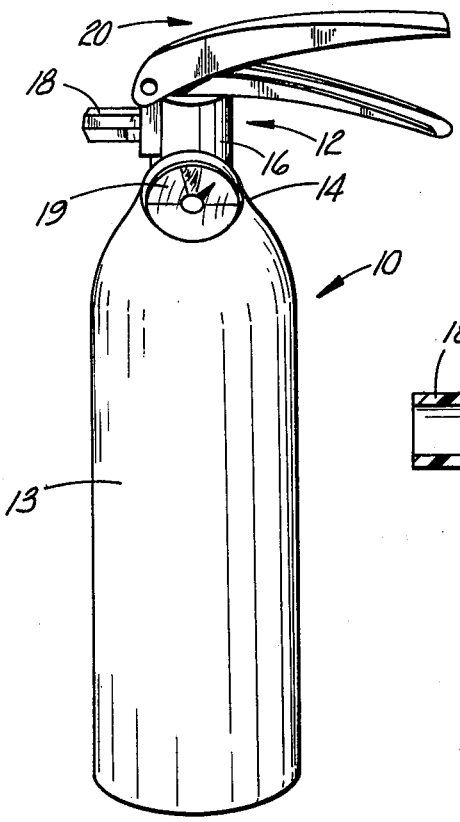
FIG. 1 is a perspective view of a portable fire extinguisher embodying the concept of the present invention.

FIG. 1 illustrates a fairly typical portable fire extinguisher indicated generally at 10 with the addition of the hand controlled release valve of this invention, indicated generally at 12. The fire extinguisher 10 includes a tank 13 generally formed of aluminum. The very top of the tank 13 has a neck portion 14 with an internal thread (not shown in FIG. 1). A valve body 16 is removably attached to the tank 13 by means external threads (not shown in FIG. 1) corresponding to the internal threads in the neck portion 14 of the tank.

The valve body 16 includes internally a conventional valve mechanism, to be described subsequently. The exterior of the valve body 16 has attached thereto an exhaust nozzle 18, a pressure gauge 19 and a handle mechanism shown generally at 20.

Figure 2:
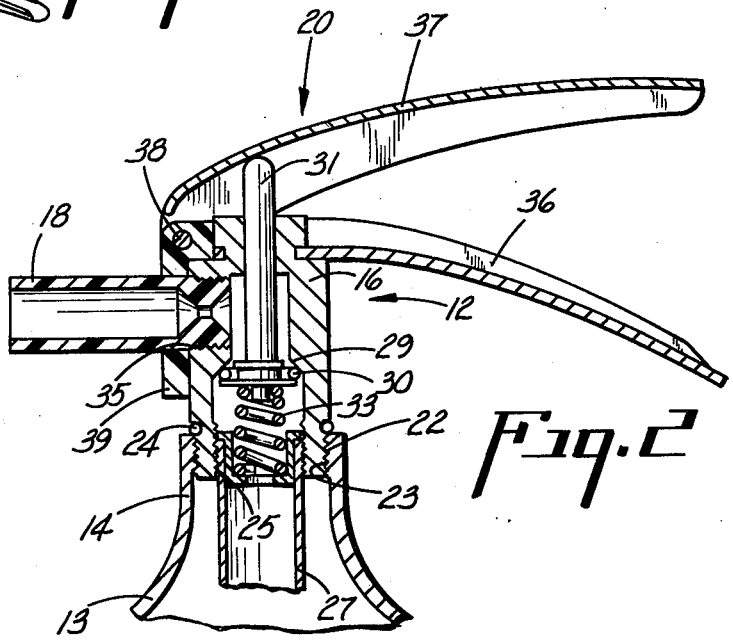
FIG. 2 is a cross-sectional view of the valve body and associated hardware for the fire extinguisher of this invention.

FIG. 2 illustrates in further detail the hand controlled release valve 12 of this invention. As explained above, the valve body 16 surface has external threads 22 on the lower portion thereof. The neck portion 14 of the tank 13 has corresponding internal threads 23 therein. The external 22 and internal 23 threads are shown intermeshed in FIG. 2 thus sealingly attaching the valve body 16 to the tank 13. A seal 24 may be provided between the valve body and the tank to insure sealing therebetween.

The interior of the valve body surface, at its lower portion, has internal threads 25 therein. A siphon tube 27 with external threads at one end thereof is attached to the valve body 16 by reason of being threaded into the internal threads 25. The siphon tube 27 (only partially shown) is, of course, intended to affect pickup and discharge of the pressurized fluid in the tank 13 from the bottom of the tank.

The inside of the valve body 16 has a valve seat 29 machined or otherwise provided therein. A valve 30 having a stem 31 is positioned within the valve body 16 with the stem protruding through the upper end of the valve body. The valve 30 has a seat corresponding to the valve seat 29 of the valve body 16 and is maintained in contact with the valve seat 29 by reason of a spring 33 positioned, by any suitable means, between the valve 30 and the bottom of the valve body 16. When the valve 30 is desired to be unseated from the valve seat 29 for the purpose of allowing pressurized fluid to pass out of the extinguisher, the valve stem 31 is forced downward causing the spring 33 to be compressed.

The valve body also has an aperture 34 near its lower end through which the pressure gauge 19 is operatively connected by reason of threading or other suitable means. As noted above, the exhaust nozzle 18 is likewise operatively connected to the valve body 16 through an aperture 35 so that when the valve 30 is opened the fluid passes through the nozzle 18 and out of the extinguisher. The means by which the exhaust nozzle 18 is connected to the valve body 16 in this particular invention will be fully explained subsequently.

FIG. 2 also illustrates the handle mechanism 20 utilized to activate the fire extinguisher. A lower handle 36 is attached to the valve body 16 in a manner not allowing any relative movement between the valve body 16 and the lower handle 36. An upper handle 37 is attached to the valve body 16 in a manner allowing the handle 37 to pivot relative to the valve body. Both the lower 36 and upper 37 handles are secured to the valve body 16 by reason of a pin 38 positioned through appropriate apertures in both handles. The pin 38 also secures a harness 39 to the valve body 16.

Figure 3:
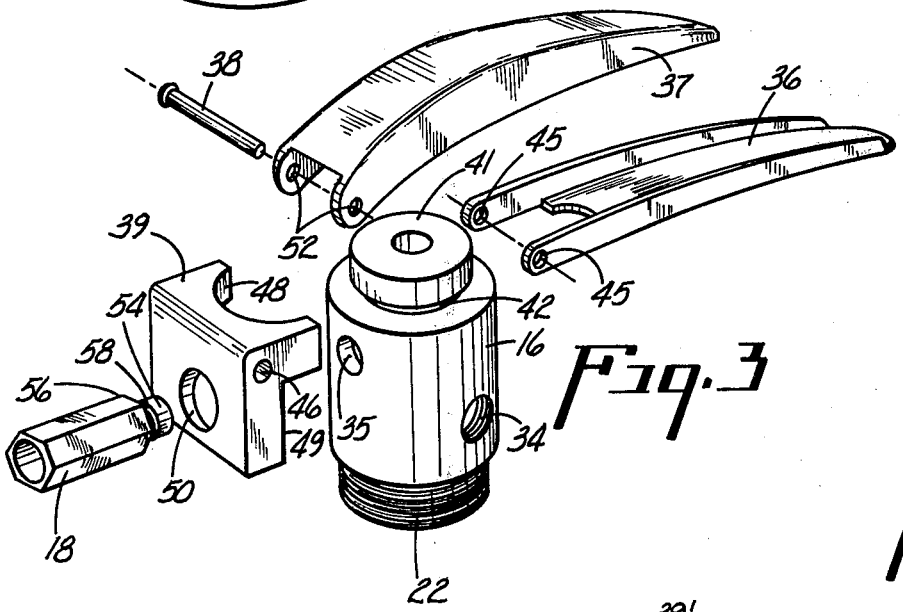
FIG. 3 is an exploded detail in perspective of the valve body and associated hardware of this invention.

The design and cooperation of the component parts of the handle mechanism 20 are more easily understood through reference to FIG. 3. Since the basic desire of this invention is to make the handle mechanism efficient, dependable and inexpensive, the adaption of the component parts to the valve body 16 is the major concern. The handle mechanism is desired to be attached to the valve body 16 through the use of only one pivot pin, while maintaining simplicity of design and manufacture of the valve body.

As evident from FIG. 3, the valve body 16 is simple in design enabling ease in manufacture whether casting or machining is utilized to produce the same. In this respect, the valve body 16 is designed so as to not require any integral flanges, bosses, or other nonsymmetrical surfaces. The valve body 16 shown in the figures is a cylindrical section. As noted above, there are external threads 22 and internal threads (not shown in FIG. 3) at the lower portion of the valve body. The valve body has an opening, concentric with the center thereof, for the valve 30 and valve stem 31.

At the top of the valve body, a reduced portion 41 is partially separated from the remainder of the valve body by a circumferential slot 42. The entire valve body, including the reduced portion 41 and circumferential slot 42, are constructed so that symmetry is maintained. In this respect, the orientation of the valve body is not significant, with regard to front and back, until the apertures 35 and 34 for the nozzle 18 and gauge 19, respectively, have been produced in the valve body.

Figure 4:
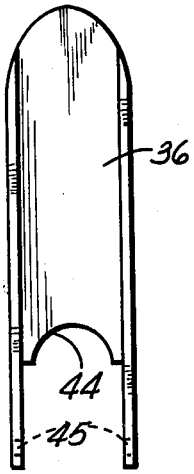
FIG. 4 is a plan view of the lower handle of the fire extinguisher of this invention.
Figure 5A:
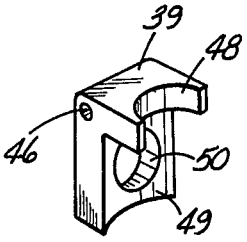
FIG. 5*a* is a bottom plan view of a harness for use with a cylindrical valve body.
Figure 5B:
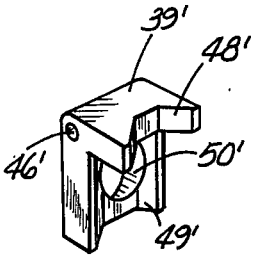
FIG. 5*b* is a bottom plan view of a harness for use with a hexagonal shaped valve body.
Figure 5C:
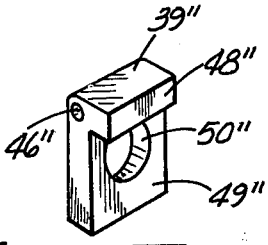
FIG. 5*c* is a bottom plan view of a harness for use with a valve body having a full flat surface.

While the lower handle 36 is designed generally much like handles in the prior art, the inside surface is of importance. FIG. 4 illustrates the detail of the inside of the lower handle 36. It can be readily seen that a center portion 44 of the flat of the handle 36 is arcuate in shape. The arcuate shape of the center portion 44 corresponds to the circumferential slot 42 of the valve body 16. In this manner, the lower handle 36 is fixed to the valve body 16 by sliding the center portion 44 into the circumferential slot 42. The upright ends of the lower handle 36 have apertures 45 therein through which the pin 38 fits.

The harness 39 is the next part in the assembly of the handle mechanism 20 and is of a size correspondng to but slightly smaller than, the end of the lower handle 36. The harness 39 has an aperture 46, through the top portion, of a sufficient size to allow the pin 38 to pass therethrough. The harness 39 has an upper face 48 which abuts the reduced portion 41 of the valve body and a lower face 49 which abuts the full surface of the valve body 16. On the lower face 49 of the harness an aperture 50 is provided which is similar in dimensions to the aperture 35 into which the exhaust nozzle 18 is to be inserted.

The upper handle 37 is designed to be slightly larger, in width, than the lower handle 36 so that the handle 37 fits over the handle 36. At one end of the upper handle 37 the upright surfaces have apertures 52 therethrough in order to allow the pin 38 to pass through.

Once the component parts of the handle mechanism 20 have been assembled on the valve body 16 as noted above, the pin 38 is inserted through the apertures 52, 45 and 46, respectively. The pin 38 may be a rivet which is permanently enlarged after being inserted, a bolt which is fastened with a nut or any other suitable fastening means.

FIGS. *5a*, *5b* and *5c* illustrate alternatives to the design of the harness 39. Since the discussion above concerned a cylindrical shaped valve body, the faces upper and lower, 48 and 49, respectively, of the harness 39 are preferred to be cylindrical segments as shown in FIG. *5a*. However, the valve body 16 and reduced portion 41 are not limited merely to cylindrical in shape.

In this regard, the valve body 16 may be hexagonal in shape and the reduced portion 41 likewise. FIG. *5b* shows a modified harness 39' with a modified upper face 48' and modified lower face 49' to match the hexagonal shape. It should be noted that it is not necessary that both the valve body 16 and reduced portion 41 be of the same geometric shape, i.e., the valve body 16 may be hexagonal while the reduced portion 41 is cylindrical. The only requirement is that the harness faces 48 and 49 correspond to the valve body and reduced portion.

FIG. *5c* illustrates yet another modified harness 39''. The valve body 16 and reduced portion 41 in this case have flat surfaces and thus a modified upper face 48'' and modified lower face 49'' also are flat. The same comment as above, with respect to one face 48'' being different in shape than the other face 49'' applied in this case.

It may be easily understood that without the harness 39 the handle mechanism 20 would be capable of rotating completely around the valve body 16 while maintaining the center portion 44 of handle 36 secured in the circumferential slot 42. This, of course, is not desirable for a number of reasons. In order to render the handle mechanism 20 permanent with respect to the valve body 16 and more precisely the exhaust nozzle 18, the harness 39 is utilized to restrain the handle mechanism 20. As noted above, the exhaust nozzle 18 is inserted through the apertures 50 and 35 in the harness 39 and valve body 16, respectively. Obviously, once the exhaust nozzle 18 is inserted the handle mechanism can no longer rotate.

There are a number of ways in which the exhaust nozzle 18 may be inserted and retained in the valve body 16. The simplest method is to provide matching threads in the aperture 35 and on an extreme end 54 of the nozzle 18. Once the nozzle 18 is threaded into the aperture 35 of the valve body, through the harness 39, the nozzle would be retained.

Since the harness 39 is available, it may be utilized to simplify the attachment of the exhaust nozzle 18. In this respect, threads could be provided in the aperture 50 of the harness 39. Corresponding threads could likewise be provided at a portion 56 of the nozzle 18 removed from the end 54. The nozzle 18 would be threaded into the harness 39 and then inserted into the aperture 35 as the handle mechanism 20 is assembled.

In order to assure a sealing engagement between the nozzle 18 and the valve body 16, just before the extreme end 54 of the nozzle 18 a peripheral groove 58 is provided. The peripheral groove 58 is so arranged that when the nozzle 18 is fully inserted into the aperture 35 of the valve body 16, the groove 58 is within the aperture 35. A seal, gasket or O-ring (not shown in the figures) is inserted into the peripheral groove 58 so that sealing is assured between the nozzle 18 and the aperture 35.

The presence of the harness 39 may be utilized still further, to completely eliminate threads on any of the parts related to attaching the exhaust nozzle 18. In this respect, a flange (not shown in the figures) may be provided at the exterior of the portion 56 of the exhaust nozzle 18. The flange would be designed to be capable of holding the nozzle in position when the handle mechanism 20 has been fully assembled by being trapped between the harness 39 and the valve body 16. In this instance the seal, gasket or O-ring, must be inserted in the peripheral groove 58 in order to assure sealing engagement. The harness 39 may be provided with a seat (not shown) on the lower face 49 into which the flange is to be inserted, but such a design is not necessary.

Modifications, changes and improvements to the preferred forms of the invention herein disclosed, described and illustrated may occur to those skilled in the art who come to understood the principles and precepts thereof. Accordingly, the scope of the patent to be issued hereon should not be limited to the particular embodiments of the invention set forth herein, but rather should be limited by the advance by which the invention has promoted the art.

What is claimed is:

1. A fire extinguisher comprising tank means for holding fluid under pressure, valve means operable from a closed condition to an open condition to effect a discharge of fluid from said fire extinguisher, said valve means including a valve body connected with one end portion of said tank means, said valve body including surface means defining a groove in said valve body, said groove having a bottom surface and upper and lower side surfaces which extend outwardly from said bottom surface, first handle means for supporting said fire extinguisher, said first handle means including a body portion adapted to be manually engaged during operation of said fire extinguisher and an end portion disposed adjacent to said valve body, said end portion including an end surface disposed in engagement with said bottom surface of said groove and side surfaces disposed in engagement with said upper and lower side surfaces of said groove, said end portion further including a pair of spaced apart and generally parallel support arms extending outwardly from opposite sides of said end surface and disposed adjacent to opposite sides of said valve body, second handle means for actuating said valve means, said second handle means being connected with outer end portions of said support arms on a side of said valve body opposite from a side of said valve body on which said body portion of said first handle means is disposed, and nozzle means connected with said valve body for directing a flow of fluid upon actuation of said valve means, said nozzle means being disposed on a side of said valve body opposite from the side of said valve body on which said body portion of said first handle means is disposed.

2. A fire extinguisher as set forth in claim 1 further including pin means extending between opposite end portions of said support arms for pivotally connecting said second handle means with said first handle means and for holding said end portion of said first handle means in said groove.

3. A fire extinguisher as set forth in claim 2 wherein said nozzle means is connected with said valve body at a location spaced apart from and disposed directly beneath a portion of said pin means disposed between said outer end portions of said support arms.

4. A fire extinguisher as set forth in claim 2 wherein said pin means extends between said outer end portions of said support arms at a location adjacent to a portion of said groove which is opposite from a portion of said groove engaged by said end surface of said first handle means.

5. A fire extinguisher as set forth in claim 1 further including a harness member attached to said first and second handle means and having an aperture through which said nozzle means extends into engagement with said valve body.

6. A fire extinguisher as set forth in claim 5 wherein said harness member includes arcuate surface means for abuttingly engaging a cylindrical valve body.

7. A fire extinguisher as set forth in claim 5 wherein said harness member includes flat surface means for abuttingly engaging a flat side of a valve body.

8. A fire extinguisher as set forth in claim 1 wherein said groove extends around said valve body and has a circular bottom surface, said end surface of said first handle means having an arcuate configuration and being disposed in abutting engagement with said circular bottom surface of said groove.

9. A fire extinguisher comprising tank means for holding fluid under pressure, valve means operable from a closed condition to an open condition to effect a discharge of fluid from said fire extinguisher, said valve means including a valve body connected with one end portion of said tank means, first handle means for supporting said fire extinguisher, said first handle means including a body portion adapted to be manually engaged during operation of said fire extinguisher and an end portion disposed adjacent to said valve body, said end portion including an end surface disposed in engagement with said valve body and a pair of spaced apart and generally parallel support arms extending outwardly from opposite sides of said end surface and disposed adjacent to opposite sides of said valve body, second handle means for actuating said valve means, said second handle means being connected with outer end portions of said support arms on a side of said valve body opposite from a side of said valve body on which said body portion of said first handle means is disposed, nozzle means connected with said valve body for directing a flow of fluid upon actuation of said valve means, said nozzle means being disposed on a side of said valve body opposite from the side of said valve body on which said body portion of said first handle means is disposed, a harness member having a side surface disposed in abutting engagement with said valve body and an end portion disposed between said end portions of said support arms, said harness member having an aperture through which said nozzle means extends into engagement with said valve body, and pin means extending between said end portions of said support arms for connecting said first and second handle means with each other and for connecting said first and second handle means with said end portion of said harness member.

10. A fire extinguisher as set forth in claim 9 wherein said valve body includes surface means defining a groove having a bottom surface and upper and lower side surfaces which extend outwardly from said bottom surface, said end surface of said first handle means being disposed in abutting engagement with said bottom surface of said groove.

11. A fire extinguisher comprising tank means for holding fluid under pressure, valve means operable from a closed condition to an open condition to effect a discharge of fluid from said fire extinguisher, said valve means including a valve body connected with one end portion of said tank means, said valve body including surface means defining a continuous groove extending around said valve body, said groove having a circular bottom surface and upper and lower side surfaces which extending outwardly from said bottom surface, first handle means for supporting said fire extinguisher, said first handle means including a body portion adapted to be manually engaged during operation of said fire extinguisher and an end portion disposed adjacent to said valve body, said end portion including an arcuate end surface disposed in engagement with said circular bottom surface of said groove and side surfaces disposed in engagement with said upper and lower side surfaces of said groove, said end portion further including a pair of spaced apart and generally parallel support arms extending outwardly from opposite sides of said arcuate end surface and disposed adjacent to opposite sides of said valve body, second handle means for actuating said valve means, said second handle means being connected with outer end portions of said support arms on a side of said valve body opposite from a side of said valve body on which said body portion of said first handle means is disposed, nozzle means connected with said valve body for directing a flow of fluid upon actuation of said valve means, said nozzle means being disposed on a side of said valve body opposite from the side of said valve body on which said body portion of said first handle means is disposed, and pin means extending between opposite end portions of said support arms for pivotally connecting said second handle means with said first handle means and for holding said arcuate end surface of said first handle means in abutting engagement with said circular bottom surface of said groove, said nozzle means being connected with said valve body at a location disposed directly beneath a portion of said pin means disposed between said outer end portions of said support arms.

* * * * *

UNITED STATES PATENT OFFICE

CERTIFICATE OF CORRECTION

Patent No. 4,019,584 Dated April 26, 1977

Inventor(s) Norbert Allmendinger

It is certified that error appears in the above-identified patent and that said Letters Patent are hereby corrected as shown below:

Column 8, line 36 change "extending" to --extend--.

Signed and Sealed this twenty-sixth Day of July 1977

[SEAL]

Attest:

RUTH C. MASON
Attesting Officer

C. MARSHALL DANN
Commissioner of Patents and Trademarks